US007654257B2

(12) United States Patent
Vancak

(10) Patent No.: US 7,654,257 B2
(45) Date of Patent: Feb. 2, 2010

(54) RADIANT HEATER ASSEMBLY

(76) Inventor: John Vancak, 415-13 St. NW., Calgary, Alberta (CA) T2N 123

( * ) Notice: Subject to any disclaimer, the term of this patent is extended or adjusted under 35 U.S.C. 154(b) by 0 days.

(21) Appl. No.: 11/798,995

(22) Filed: May 18, 2007

(65) Prior Publication Data

US 2008/0283047 A1 Nov. 20, 2008

(51) Int. Cl.
*F23C 3/00* (2006.01)

(52) U.S. Cl. ..... 126/91 A

(58) Field of Classification Search ..... 126/91 A, 126/91 R, 110 R, 116 R, 99 A, 376.1; 122/44.1; 432/206, 209, 148, 102, 175; D24/209, 210; 123/217, 73 SC See application file for complete search history.

(56) References Cited

U.S. PATENT DOCUMENTS 2,491,000 A * 12/1949 Cone ..... 432/209
2,823,659 A * 2/1958 Fallon ..... 126/91 A
2,910,285 A * 10/1959 Harris ..... 432/198
3,307,529 A * 3/1967 Fannon, Jr. et al. ..... 126/92 B
3,489,134 A * 1/1970 Cowan ..... 126/91 A
4,479,535 A * 10/1984 Echigo et al. ..... 165/142
5,203,690 A * 4/1993 Maruko ..... 431/236
5,429,112 A * 7/1995 Rozzi ..... 126/116 A
5,626,125 A * 5/1997 Eaves ..... 126/91 A
5,628,303 A * 5/1997 Ahmady et al. ..... 126/91 A
6,029,647 A * 2/2000 Pisano et al. ..... 126/91 A
6,321,743 B1 * 11/2001 Khinkis et al. ..... 126/91 A
2006/0108721 A1 * 5/2006 Weaver ..... 266/90

FOREIGN PATENT DOCUMENTS

JP 11014016 A * 1/1999
RU 2202736 C1 * 4/2003

* cited by examiner

*Primary Examiner*—Kenneth B Rinehart
*Assistant Examiner*—Jorge Pereiro
(74) *Attorney, Agent, or Firm*—George A. Seaby

(57) ABSTRACT

A radiant tube heater assembly includes a housing containing a blower and a burner, which is aligned with an opening in the housing through which a flame and products of combustion flow into a U-shaped burner tube. The closed downstream end of the burner tube is in close proximity to the housing. In order to prevent or reduce the likelihood of the products of combustion entering the blower, an exhaust tube is mounted in a downstream leg of the burner tube and extends outwardly through the U-shaped outer end of the tube remote from the housing.

2 Claims, 2 Drawing Sheets

RADIANT HEATER ASSEMBLY

BACKGROUND OF THE INVENTION

1. Field of the Invention

This invention relates to a radiant heater assembly, and in particular to a heater assembly for mounting in an overhead location.

2. Description of Related Art

In general, an overhead radiant heater includes a housing containing a blower for introducing air into the area of a burner and for carrying a flame and the by-products of combustion through an elongated burner tube. The burner tube is surrounded on three sides by a metal reflector, which directs heat from the tube downwardly into a room or outdoor area beneath the heater. Over the years, various changes have been made to such heaters to make them more efficient. For example, baffles or turbulators have been mounted in the burner tube. In this connection reference is made to CA Patent Application No. 2,122,221 (Rozzi), filed Apr. 26, 2994.

In order to make the heaters more compact, straight, elongated burner tubes have been replaced with generally U-shaped tubes. Examples of heaters with such tubes are seen in CA Patent Application No. 2,014,218 (Duverger), filed Apr. 9, 1990 and U.S. Pat. Nos. 4,673,348 (Riley et al), issued Jun. 16, 1987 and 5,628,303 (Ahmady et al), issued May 13, 1997.

A problem with some heaters incorporating U-shaped burner tubes is that the products of combustion are discharged from the tubes in the area of the blower housing. Thus, the gases being sucked into the blower are oxygen deprived which results in inefficient burner operation.

BRIEF SUMMARY OF THE INVENTION

An object of the present invention is to provide a solution to the above identified problem in the form of a relatively simple, compact and efficient radiant heater assembly.

Accordingly, the invention relates to a radiant tube heater assembly comprising a housing; an opening in one end of said housing; a burner in said housing aligned with said opening; a gas inlet extending into said housing and connected to said burner for introducing fuel into said burner; a blower in said housing for introducing combustion air into the housing for mixing with the fuel and for blowing a flame and the products of combustion through said opening; a U-shaped burner tube including a first leg having an open end connected to said housing around said opening for receiving the flame and the products of combustion, a U-shaped outer end remote from the housing, and a second leg extending from said outer end toward said housing, said second leg having a closed end in close proximity to the housing; and an exhaust tube in said second leg of the burner tube extending through said outer end for discharging the products of combustion from the burner tube.

DETAILED DESCRIPTION OF THE INVENTION

Figure 1:
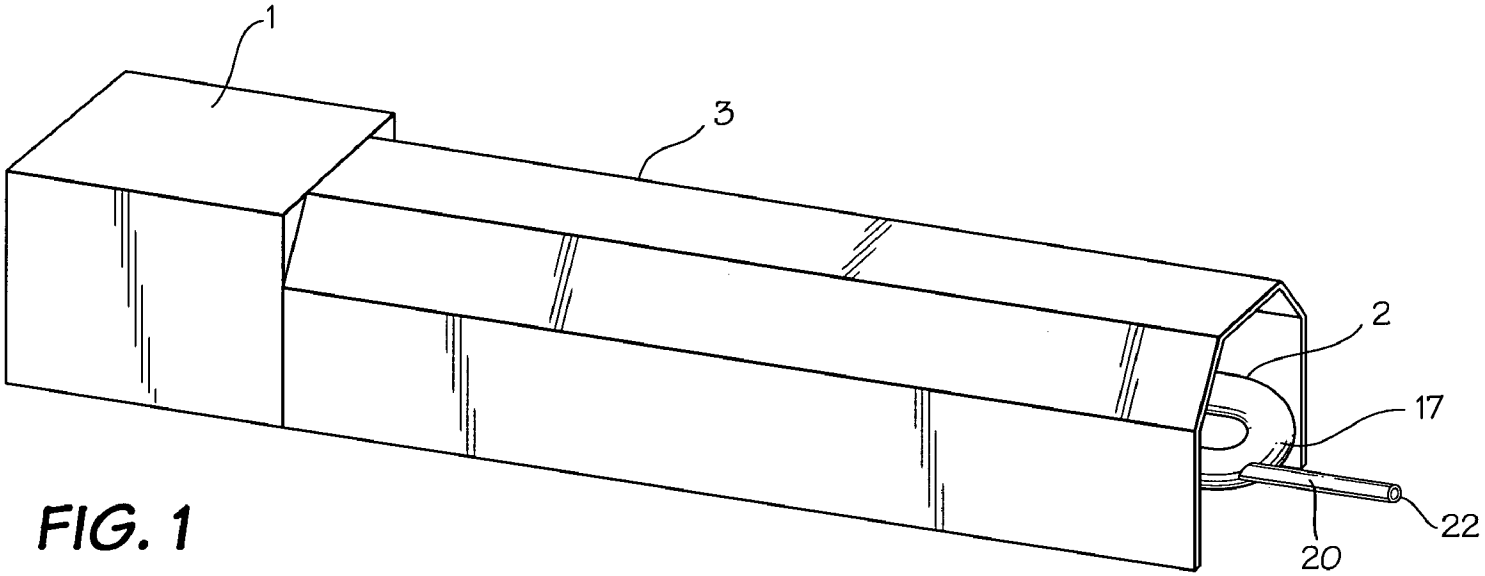
FIG. 1 is a schematic isometric view of a preferred embodiment of the radiant heater assembly of the present invention.
Figure 2:
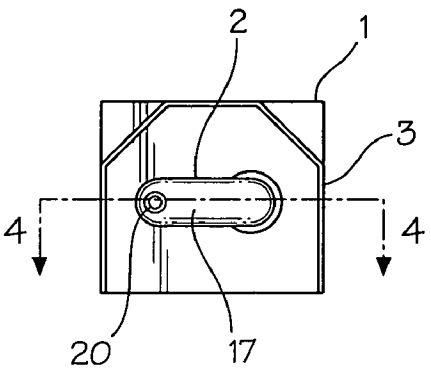
FIG. 2 is an end view of the heater assembly as seen from the right of FIG. 1.
Figure 3:
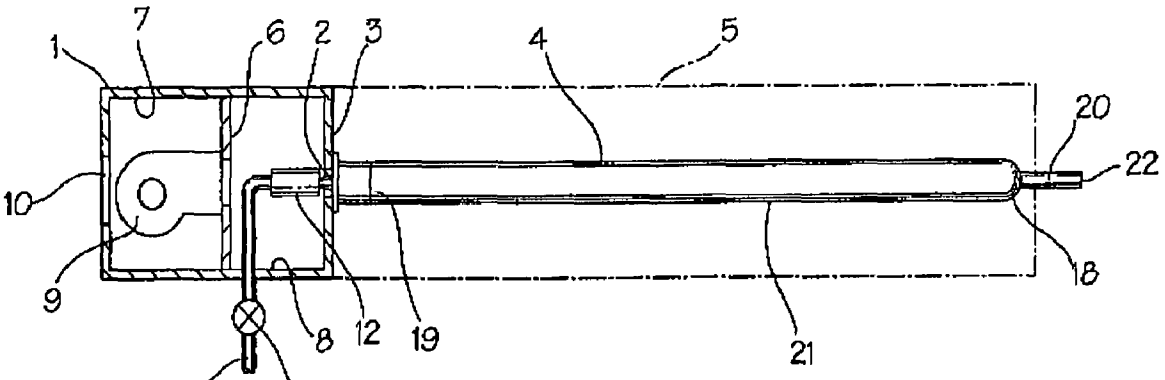
FIG. 3 is a partly sectioned side view of the heater assembly of FIGS. 1 and 2.
Figure 4:
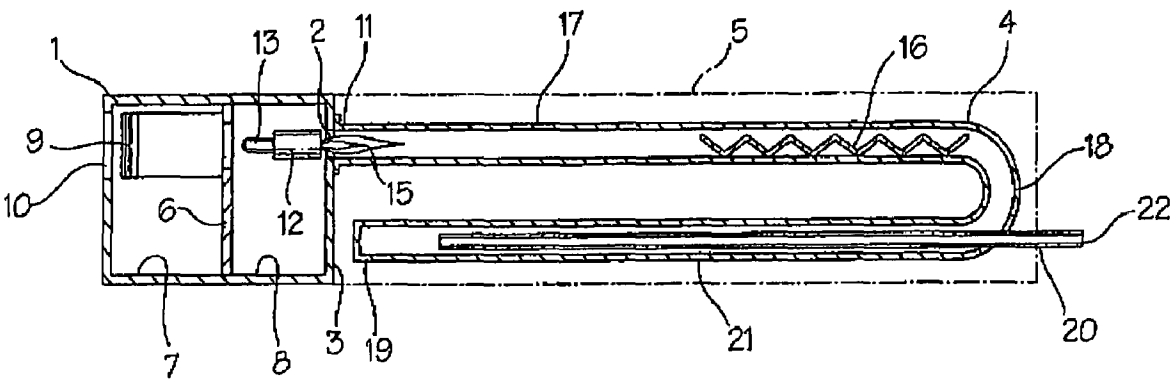
FIG. 4 is a cross-section taken along line 4-4 of FIG. 2.

Referring to the drawings, a radiant tube heater assembly in accordance with the invention includes a housing 1 with a U-shaped burner tube 2 extending outwardly therefrom. A reflector 3 around the top and sides of the burner tube 2 directs heat downwardly. A partition 4 divides the interior of the housing 1 into a pair of chambers 5 and 6. The chamber 5 contains a blower 7 for sucking combustion air into the housing, through an opening 8. The air is blown into the chamber 6 and the inlet end 9 of the burner tube 2. Gas is introduced into a burner 11 via an inlet line 12 containing a valve 13, which can be a variable input (high/low) or a single setting valve.

The flame 15 from the burner 11 enters the inlet end of the burner tube 2 and the heated products of combustion travel the length of the tube 2 passing over a corrugated baffle or turbulator 16, which acts as a heat exchanger. The baffle 16, which is optional, slows down the products of combustion, thereby scavenging more heat from exhaust gases prior to their exit from the heater assembly. The heated gases flow through a first leg and the U-shaped outer end 17 of the tube 2. In a conventional radiant heater, the products of combustion, i.e. the heated gases are discharged from the downstream end 18 of the burner tube 2.

In the assembly of the present invention, the downstream end 18 of the burner tube 2, which is proximate the housing 1, is closed and the products of combustion are discharged through an elongated exhaust tube 20. The tube 20 is coaxial with the downstream leg 21 and extends out of the end 17. The exhaust tube 20 directs exhaust gases away from the housing 1 and the area of the blower 7. Thus, spent exhaust gases are not sucked back into the burner 11 which results in cleaner combustion.

It has been found that the assembly described above has a heat output similar to that of an open flame, high intensity, infrared heater without the drawbacks of such a heater. High intensity heaters have a ceramic or stainless steel mesh burner "face" which burns a gas and air mixture, causing the burner face to glow red. The exhaust gases roll off the face and are introduced directly into the surrounding air. Having the open flame and exhaust gases introduced directly into the surrounding air increases the clearance to combustibles. In contrast, the apparatus described herein contains the flame inside a tube. All gases are inside the apparatus until they are expelled in a controlled manner at the opposite end of the burner assembly. A chimney or other vent can be attached to the exhaust tube to further direct the exhaust gases outside of a building, or away from patrons on a patio of a restaurant. The assembly has substantially lower clearance to combustions around the heater as compared to the high intensity unit, yet delivers similar heating output to the surrounding areas.

The exhaust tube increases the residence time of hot gases in the burner tube. Thus, the use of the turbulator 16 and an exhaust tube in the burner tube results in a substantially even heat output along the length of the heater assembly. This is in contrast with conventional tube style radiant heaters.

The invention claimed is:

1. A radiant tube heater assembly comprising a housing; an opening in one end of said housing; a burner in said housing aligned with said opening; a gas inlet extending into said housing and connected to said burner for introducing fuel into said burner; a blower in said housing for introducing combustion air into the housing for mixing with the fuel and for blowing a flame and the products of combustion through said opening; a U-shaped burner tube including a first leg having an open end connected to said housing around said opening for receiving the flame and the products of combustion, a U-shaped outer end remote from the housing, and a second leg extending from said U-shaped outer end toward said housing, said second leg having a closed end in close proximity to the housing; an exhaust tube coaxial with and extending through a major portion of said second leg of the burner tube and through said U-shaped outer end for discharging the products of combustion from the burner tube; and a reflector connected to said one end of said housing and extending around the top and sides of the burner tube for directing heat downwardly.

2. The heater assembly of claim 1, wherein said first and second legs of said burner tube are disposed in the same horizontal plane.

* * * * *